US005960589A

United States Patent [19]

Youngquist et al.

[11] Patent Number: 5,960,589

[45] Date of Patent: Oct. 5, 1999

[54] METHOD AND APPARATUS FOR MODULAR STADIUM SEATING SUPPORT SYSTEM

[75] Inventors: Andrew Youngquist, Newport Beach; James Lefler, Orange; Robert Herrman, Alta Loma; Harold K. Matsumoto, Glendora, all of Calif.

[73] Assignee: Stadium Seating Erectors, Costa Mesa, Calif.

[21] Appl. No.: 09/123,157

[22] Filed: Jul. 27, 1998

[51] Int. Cl.[6] ..... E04H 3/22

[52] U.S. Cl. ..... 52/8; 52/6; 52/9

[58] Field of Search ..... 52/6, 8, 9

[56] References Cited

U.S. PATENT DOCUMENTS

| | | | |
|---|---|---|---|
| Re. 29,635 | 5/1978 | McClelland et al. | 52/9 |
| 1,965,486 | 7/1934 | Cannon | 52/8 |
| 5,050,353 | 9/1991 | Rogers et al. | 52/8 |
| 5,813,663 | 9/1998 | Victor et al. | 52/9 X |

FOREIGN PATENT DOCUMENTS

| | | | |
|---|---|---|---|
| 2605037 | 4/1988 | France | 52/8 |
| WO8901084 | 2/1989 | WIPO | 52/8 |

*Primary Examiner*—Carl D. Friedman
*Assistant Examiner*—Phi Dieu Tran A.
*Attorney, Agent, or Firm*—Thomas I. Rozsa; Tony D. Chen; Jerry Fong

[57] ABSTRACT

A modular structure is assembled through a multiplicity of modules aligned in a series of horizontal rows, with each successive row being higher than the preceding row by a given height. Each row is composed of series of adjacent modules of the same height in that row, the modules composed of four vertical posts with adjacent modules sharing the same two intermediate posts between them. In alternating rows, the vertical posts are strengthened by widthwise crossbeams extending from adjacent the top of one vertical post to adjacent the bottom the next vertical post for all widthwise pairs of vertical posts in the given row. Each vertical post is anchored to the ground by being welded to a base plate assembly which in turn in bolted or anchored into the ground or concrete floor. Each module supports a concrete formed bed. The concrete bed is formed by a pair of oppositely disposed lengthwise right angle support members on each module which extend for the length of a given row and bounded on each end of the row by a transverse right angle support member. A metal bed is supported by the oppositely disposed lengthwise right angle support members in each module to form the floor of the concrete bed and concrete is poured for the entire length and width of each module to form a floor in a given row. Seats are thereafter positioned on the concrete floor.

12 Claims, 7 Drawing Sheets

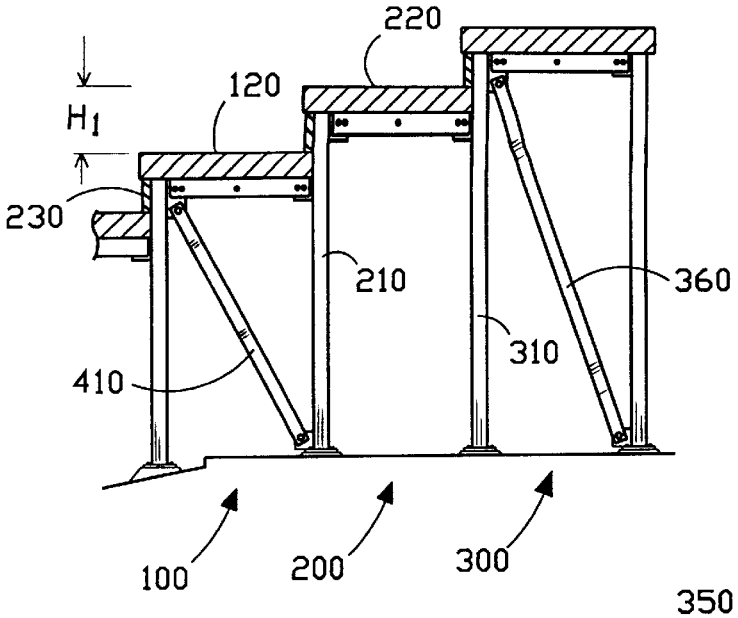
FIG.3
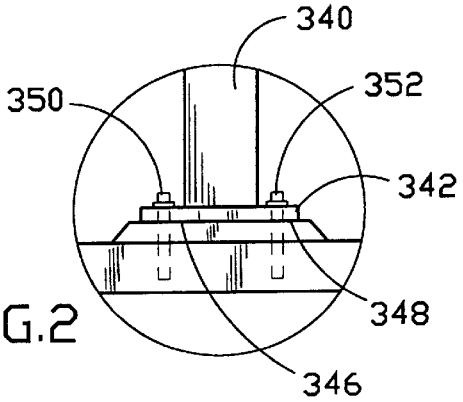
FIG.2
FIG.4
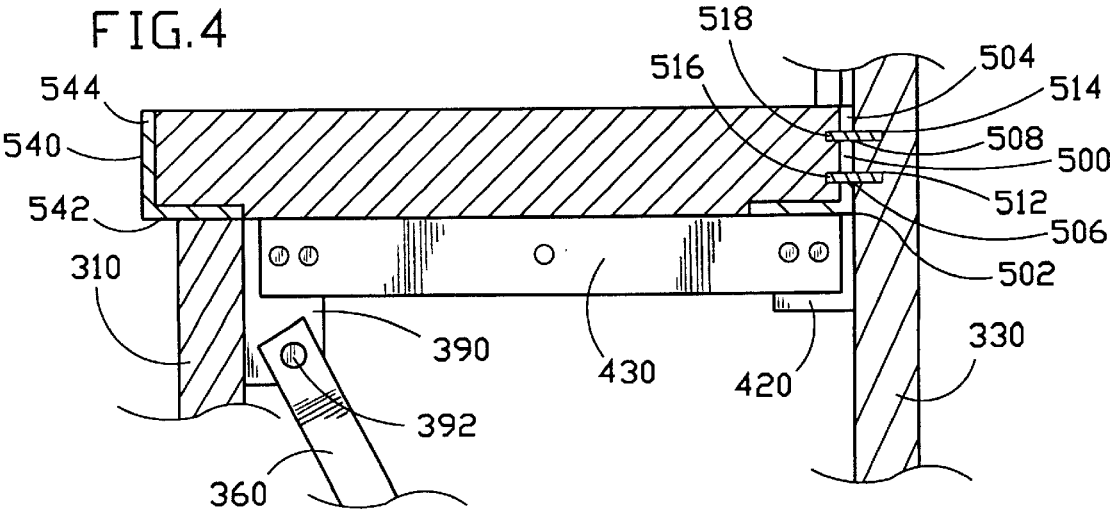

FIG.11
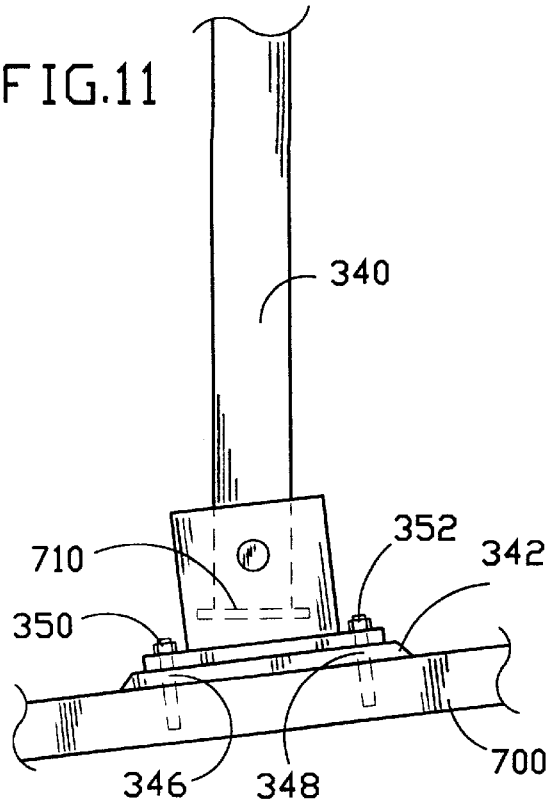
FIG.12
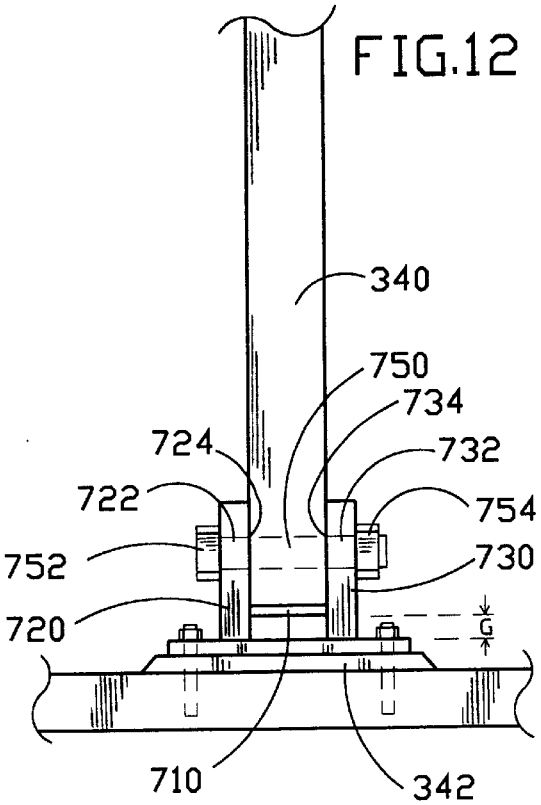
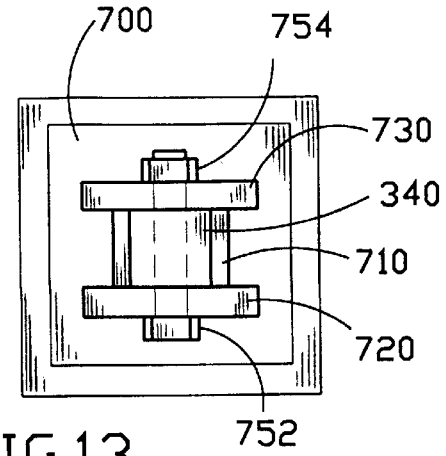
FIG.13

METHOD AND APPARATUS FOR MODULAR STADIUM SEATING SUPPORT SYSTEM

BACKGROUND OF THE INVENTION

1. Field of the Invention

The present invention relates to the field of support structures for supporting the floor of a structure, which floor in turn supports a multiplicity of rows of seats. More particularly, the present invention is intended to support stadium seating which is a series of rows of seats wherein each respective row moving away from the front row is elevated above the immediately preceding row so that a customer's view will not be obstructed by people sitting in rows ahead of the customer.

2. Description of the Prior Art

In general, stadium seating is erected by individual construction of the various support members which includes jackhammering the foundation to permit the structure to be anchored into the ground and assembling the structure in a piece-by-piece method. The construction of conventional prior art stadium seating support structures is time consuming and requires skilled labor to properly build the unit Conventional stadium seating construction apparatus and methods are therefore time consuming and require skilled labor. This is a serious drawback when it is necessary to retrofit an existing seating venue such as a movie theater, where it is necessary to minimize the downtime during which the theater will be out of operation during the retrofit process and where cost and the desire to utilize unskilled labor to erect the stadium seating support structure is of great importance.

SUMMARY OF THE PRESENT INVENTION

The present invention is a novel method and apparatus for a stadium seating support system which can be utilized in both new seating construction and also for retrofitting an existing seating venue. In particular, the present invention is a modular system whereby the entire structure can be attached to the ground without the necessity of jackhammering or otherwise breaking up the support floor and the entire system is modular and color coded and/or individually piece marked to enable unskilled labor to easily assemble the entire stadium seating support structure. The present invention is a support structure which supports a multiplicity of rows of seats wherein a given row of seats is elevated above the immediately preceding row of seats so that the view of a customer will not be obstructed by people sitting in rows in front of the row in which the customer is sitting. The present invention is especially beneficial for retrofitting existing seating venues such as a movie theater wherein it is necessary to minimize the time that the theater will be shut down while the retrofitting process is taking place.

It has been discovered, according to the present invention, that if a modular color coded and/or individually piece marked system is utilized to erect the stadium seating support structure, the system can be easily and quickly assembled with unskilled labor.

It has further been discovered, according to the present invention, that if a modular unit is comprised of vertical support members and crossbeams which have an overall cross-sectional dimension of approximately 8 feet by 44 inches, then this provides an ideal modular unit to accommodate approximately 4 patron seats for a movie theater.

It has also been discovered, according to the present invention, that utilization of an eight foot span for the modular erection support unit gives the unit a high resonant frequency which minimizes any sound reverberation transformation and vibration which could interfere with the viewer's enjoyment of a motion picture.

It has additionally been discovered, according to the present invention, that if the stadium seating support unit provides rows which are approximately 44 inches wide, then the rows for theater seats will be sufficiently wide to enable people to walk in front of the seated customers in a given row and will provide the average customer with sufficient leg room to be comfortably seated.

It has also been discovered, according to the present invention, that if the modular stadium seating structure supports a bed which is approximately 8 feet long by 44 inch wide by 6 inches deep, then concrete can be poured into the bed and be of sufficient strength to properly support 4 to 4½ seats and provide a structure that has a high resonant floor frequency to minimize sound reverberation, transformation and vibration which would interfere with viewing the motion picture.

It has further been discovered, according to the present invention, that the ideal height difference from one row to the next row is 14 inches, but that a satisfactory range can be from 10 inches to 22 inches. However, 14 inches provides a reasonable number of rows for a theater without exceeding the maximum ceiling height of most conventional theaters.

It has further been discovered, according to the present invention, that by color coding and/or individually piece marking the specific parts of a modular unit and erecting the stadium seating support unit from the same sets of color coded and/or individually piece marking modular units, the entire average motion picture theater of under 300 seats can be constructed with the stadium seating support and floor erected within 10 working days. This is critically important to existing theaters which either have a flat floor or a moderately sloped floor and require the theater to be retrofitted with stadium seating in order to compete with newly built modern theaters that have stadium seating.

It is therefore an object of the present invention to provide a novel method and apparatus for a stadium seating support system which can be utilized in both new seating construction and also for retrofitting an existing seating venue. It is an object of the present invention to provide a modular system whereby the entire structure can be attached to the ground without the necessity of jackhammering or otherwise breaking up the support floor and the entire system is modular and color coded and/or individiually piece marked to enable unskilled labor to easily assemble the entire stadium seating support structure. It is also an object of the present invention to provide a support structure which supports a multiplicity of rows of seats wherein a given row of seats is elevated above the immediately preceding row of seats so that the view of a customer will not be obstructed by people sitting in rows in front of the row in which the customer is sitting. It is an important object of the present invention to be especially beneficial for retrofitting existing seating venues such as a movie theater wherein it is necessary to minimize the time that the theater will be shut down while the retrofitting process is taking place.

It is therefore an additional object of the present invention to provide a modular color coded and/or individually piece marked system to be utilized to erect the stadium seating support structure so that the system can be easily and quickly assembled with unskilled labor.

It is a further object of the present invention to provide a modular unit which is comprised of vertical support members and crossbeams which have an overall cross-sectional dimension of approximately 8 feet by 44 inches because this provides an ideal modular unit to accommodate approximately 4 patron seats for a movie theater.

It is an additional object of the present invention to utilize an eight foot span for the modular erection support unit because this dimension provides the unit with a high resonant frequency which minimizes any sound reverberation, transformation and vibration which could interfere with the viewer's enjoyment of a motion picture.

It is also an additional object of the present invention to provide a stadium seating support unit with rows which are approximately 44 inches wide, so that the rows for theater seats will be sufficiently wide to enable people to walk in front of the seated customers in a given row and will provide the average customer with sufficient leg room to be comfortably seated.

It is a further object of the present invention to provide a modular stadium seating structure that supports a bed which is approximately 8 feet long by 44 inches wide by 6 inches deep, so that concrete can be poured into the bed and be of sufficient strength to properly support 4 to 4½ seats and provide a structure that has a high resonant floor frequency to minimize sound reverberation, transformation and vibration which would interfere with viewing the motion picture.

It is another object of the present invention to provide an ideal height difference from one row to the next row of 14 inches, but that a satisfactory range can be from 10 inches to 22 inches. However, 14 inches provides a reasonable number of rows for a theater without exceeding the maximum ceiling height of most conventional theaters.

It is a further object of the present invention to provide color coding and/or individually piece marking for the specific parts of a modular unit and erecting the stadium seating support unit from the same sets of color coded modular units so that the entire average motion picture theater of under 300 seats can be constructed with the stadium seating support and the floor erected within 10 working days. This is critically important to existing theaters which either have a flat floor or a moderately sloped floor and require the theater to be retrofitted with stadium seating in order to compete with newly built modem theaters that have stadium seating.

Further novel features and other objects of the present invention will become apparent from the following detailed description, discussion, and the appended claims, taken in conjunction with the drawings.

BRIEF DESCRIPTION OF THE DRAWINGS

Referring particularly to the drawings for the purpose of illustration only and not limitation, there is illustrated.

FIG. 2 is an enlarged side elevational view of a vertical post of the present invention attached to a base plate assembly and anchored to the ground.

FIG. 3 is a side elevational view of a portion of the present invention modular stadium seating support system.

FIG. 4 is an enlarged side elevational view of adjacent vertical post member showing attachment of gusset plates, lengthwise right angle support members and concrete bed of the present invention.

FIG. 11 is a side elevational view of an alternative embodiment of the base plate assembly to which a vertical post is pivotally attached.

FIG. 12 is a side elevational view taken at 90 degrees to the view in FIG. 11.

FIG. 13 is a top plan view.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
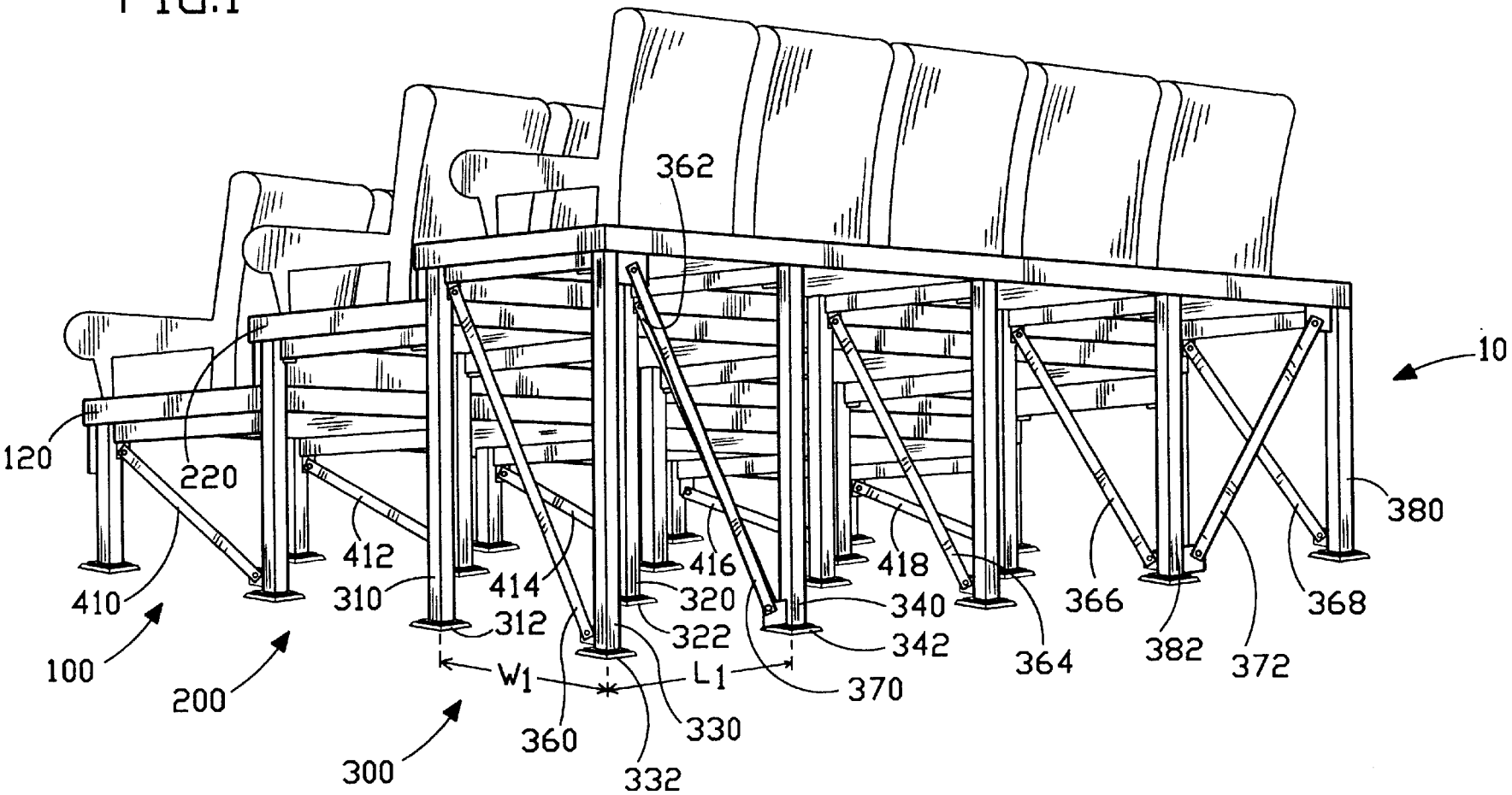
FIG. 1 is a perspective view of a portion of the completed present invention modular stadium seating support system with the outer covering broken away to show the structural components of the system.

Referring to FIG. 1, there is illustrated a perspective view of a completed structure utilizing the present invention modular stadium seating support system with the outer covering removed to show the underlying support structure of the present invention. FIG. 1 illustrates three completed rows which have patron seats supported by the present invention modular stadium seating support system. The entire three row structural system is designated as 10. The first row of support members which is the lowermost row is designated as 100. The second row of support members which is the middle row is designated as 200. The third or rearmost row of support members is designated as 300.

Referring to the rearmost row of support members 300, the modular unit of the present invention is comprised of four vertical posts or beams 310, 320, 330 and 340 which are bolted to the ground by means of their respective plates 312, 322, 332 and 342. An enlarge view of the interface between a vertical post, its support plate and the bolts to anchor the plate and beam to the ground is illustrated in FIG. 2. It will be appreciated that the structure is the same for all of the vertical posts illustrated in FIG. 1. Referring to FIG. 2, vertical post or beam 340 is attached to horizontally disposed plate 342 by means such as welding. Plate 342 contains two openings 346 and 348 through which are respectively extended anchors 350 and 352. By way of example, each anchor 350 and 352 is a Hilti Hit Hy 150 injection adhesive anchor or approved equivalent with a threaded rod which can be up to 4⅝ inches long embedded into the existing concrete slab. Through use of the present modular system, each plate is affixed to the ground by threaded bolts which thereby eliminates the need to jack-hammer or otherwise disturb the substantially level floor onto which the present invention is mounted.

It has been noticed that sometimes the floor is not flat and is sloped at the location where the vertical posts are to be anchored to the ground. It is therefore necessary to provide a pivot means to enable the base plate to be rotated relative to the vertical post so that the base plate is level with the ground to which it is anchored while at the same time the base plate can be at an angle to the vertical post so that the vertical post extends vertically upward.

Referring to FIG. 11, the sloped ground or concrete slab 700 is illustrated. The base plate 342 once again contains two openings 346 and 348 through which are respectively extended anchors 350 and 352. Therefore, in this embodiment the base plate 342 is anchored to the ground 700 as before. However, since the ground is sloped, if the post were directly welded to the base plate, the post would be at an angle and extend straight up. It is therefore necessary to provide a pivot means as illustrated in FIGS. 11 through 13 so that the post is at an angle relative to the base plate.

In a preferred embodiment, the post 340 is approximately 3 inches square. In the previous embodiment, the post 340 was directly welded to the base plate 342. In this embodiment, since the post is not directly welded to the base plate 342, there needs to be an end plate 710 welded to the bottom of the post to provide structural strength. By way of example, if the post is 3 inches square, the end plate may be 3½ inches in one direction so it juts out from the bottom of the post by ¼ inch on either side (as illustrated in FIG. 13) by 2⅝ inches in the other direction so it is concealed within the post in that direction. Since the post 340 needs to rotate relative to the base plate 342, a gap "G" which by way of example may be ½ inch is between the end plate 710 and the base plate 342. Welded to the base plate 342 are 2 vertical plates 720 and 730. Plate 720 has an opening 722 extending through it and plate 730 has an opening 732 extending through it. Post 340 has a pair of oppositely disposed and aligned openings 724 and 734 which are aligned with openings 722 and 732 respectively. A pivot means or bolt 750 extends through all of the openings 722, 724, 732 and 734 and is fastened by nuts 752 and 754 at either end. The wider end of the end plate 710 is at ninety degrees to plates 720 and 730 so that the post 340 can be rotated relative to base plate 342 without the end plate hitting the plates 720 and 730. In this way, the post 340 can be vertically oriented as illustrated in FIG. 11 even though the base plate is at an angle relative to the post 340 in order for the base plate 342 to be flat against the sloped ground or concrete slab 700.

The modular unit comprised of the four vertical posts or beams 310, 320, 330 and 340 can be spaced apart by any dimension, but it has been discovered that the preferred distances between the beams is eight (8) feet from beam centerline to beam centerline in the lengthwise direction L1 as shown in FIG. 1, and forty-four (44) inches from beam centerline to beam centerline in the widthwise direction W1 as shown in FIG. 1. This lengthwise distance L1 is the preferred dimension because it has been discovered that utilization of an eight foot distance for the modular erection support unit gives the unit a high resonant frequency which minimizes sound reverberation, transformation and vibration which could interfere with the viewer's enjoyment of a motion picture. This lengthwise distance W1 is the preferred dimension because it has been discovered that utilization of a forty-four inch (44") width provides sufficient room for a patron seat and also sufficient room to enable one to walk in front of the seat as well as sufficient patron leg room. This width may vary if the seat to be installed is larger than normal and requires a wider platform.

The four vertical beams are structurally supported by crossbeams in the widthwise direction and one crossbeam in the lengthwise direction. Referring to FIG. 1, the widthwise crossbeam 360 extends from adjacent the top of front beam 310 to adjacent the bottom of rear beam 330. The lengthwise crossbeam 370 extends from adjacent the top of rear beam 330 to adjacent the bottom of rear beam 340. It has been discovered that it is preferable to have one widthwise crossbeam for every modular unit in a given row in order to provide sufficient strength for the row. This is illustrated in FIG. 1 showing widthwise crossbeams 360, 362, 364, 366 and 368 on each modular unit along rearmost row 300. It has further been discovered that it is only necessary to have such widthwise crossbeams on every other row as the widthwise crossbeam from one row provides sufficient strength to its adjacent row to avoid the necessity and expense of putting a widthwise crossbeam on each modular unit of each row. Referring to FIG. 1, the first or lowermost row 100 has widthwise crossbeams 410, 412, 414, 416 and 418, the second row 200 does not have any widthwise crossbeam, and the third or rearmost row 300 has the widthwise crossbeams beginning with 360 as just described.

It has further been discovered that it is preferable to have one lengthwise crossbeam for every other modular unit in a given row in order to provide sufficient strength for the row. This is illustrated in FIG. 1 showing lengthwise crossbeams 370 and 372 on every other modular unit along rearmost row 300. Since there are only four modular units depicted on rearmost row 300, one lengthwise crossbeam 370 is on the first unit and extends from adjacent the top of rear post 330 to adjacent the bottom of rear post 340. The second lengthwise crossbeam 372 is on the last or fourth modular unit and extends from adjacent the top of outer rear post 380 to adjacent the bottom of interior rear post 382. If there were more than four modular units in row 300, then there would be a lengthwise crossbeam extending from one post to an adjacent post on every other unit. It has further been discovered that it is only necessary to have such lengthwise crossbeams on every other row as the lengthwise crossbeams from one row provide sufficient strength to its adjacent row to avoid the necessity and expense of putting lengthwise crossbeams on every other modular unit of each row. Therefore, the rearmost row 300 has the lengthwise crossbeams 370 and 372 as depicted, the middle row 200 down not have any lengthwise crossbeams, and the first row 100 would also have two lengthwise crossbeams comparable to the lengthwise crossbeams shown in row 300.

The way a crossbeam is attached to a post is illustrated in FIG. 4. A gusset plate 390 is welded to a post such as 310. The gusset plate 390 has at least one opening extending through its thickness. Widthwise crossbeam 360 also has at least one opening adjacent its end. The openings in the gusset plate 390 and crossbeam 360 are aligned and bolt 392 is inserted through the aligned openings and fastened with a nut. For increased strength of connection, the present invention also anticipates having two openings in gusset plate 390 and two aligned openings in crossbeam 360 so that two bolts can be inserted through each of a respective pair of aligned openings to provide extra strength at this connection point. Each of the crossbeams illustrated in FIG. 1 is connected in this manner by having a gusset plate welded to the post adjacent one end of the post and the crossbeam being bolted to the gusset plate as shown in FIG. 4.

Figure 5:
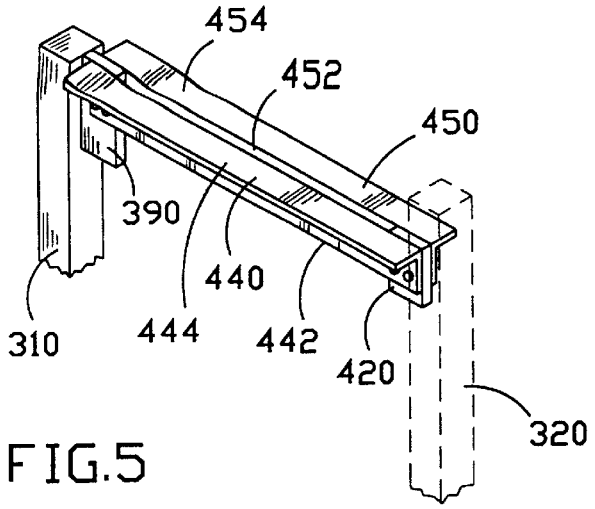
FIG. 5 is a perspective view of a pair of oppositely disposed horizontal right angle support members sandwiching and attached to a pair of gusset plates forming a part of the concrete bed support structure of the present invention.

The modular structure is designed to support a finished slab of concrete which in the preferred embodiment is 6 inches deep, 44 inches wide and runs the entire length of the combined modular sections. The preferred method of attaching and supporting the concrete bed will now described. Referring to FIG. 4, a pair of oppositely disposed gusset plates is welded to oppositely disposed posts. Gusset plate 390 welded to post 310 adjacent the top of post 310 has already been described. Gusset plate 420 is welded to post 320 at a location approximately 6 inches below the top of post 320. Each gusset plate has a pair of openings extending through its thickness. A pair of right angle support members which is approximately 4 inches high and 3 inches wide is bolted to opposite sides of each gusset plate so as to sandwich the gusset plate between them. Referring to FIG. 5, right angle support member 440 has a vertical component 442 which is bolted to gusset plates 390 and adjacent its opposite ends and a horizontal component 444. Right angle support member 450 is a mirror image of right angle support member 440 and has a vertical component 452 which is bolted to gusset plates 390 and 392 adjacent its opposite ends, with the same bolts used to fasten right angle support member 440, and a horizontal component 454 which extends in the opposite direction from horizontal component 444. The gusset plate 390 is welded adjacent to the top of post 310 while gusset plate 420 is welded approximately 6 inches below the top of post 320.

Figure 6:
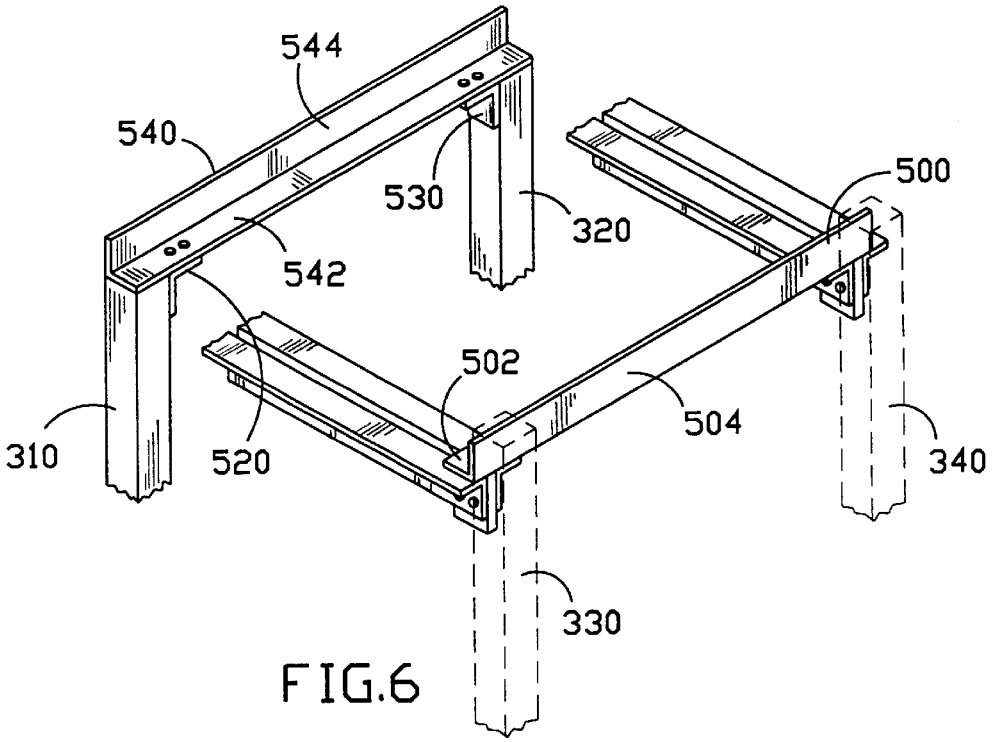
FIG. 6 is a perspective view of a pair of oppositely disposed lengthwise right angle support members and their relationship to vertical posts and horizontal right angle support members, forming a part of the concrete bed support structure of the present invention.

A pair of right angle support members is attached to two opposite posts in the lengthwise direction. Referring to FIGS. 4 and 6, lengthwise right angle support member 500 has a horizontal component 502 and a vertical component 504. The vertical component has openings adjacent its opposite ends which are aligned with openings in two lengthwise posts 330 and 340 so that lengthwise right angle support member 500 is bolted to posts 330 and 340. The left side portions are illustrated in FIG. 4 where vertical component 504 has openings 506 and 508 respectively aligned with threaded openings 512 and 514 in post 330 and bolted thereto by bolts 516 and 518. The right side of vertical components 504 has comparable openings so that it can be bolted to vertical post 540 in the manner just described.

The horizontal component 502 sits on top of and is fastened to horizontal component 454 of member 450 at one end and to the equivalent of horizontal member 444 of support member 440 at its opposite end. A gusset plate 520 is welded to the top of front post 310 and a second gusset plate 530 is welded to the top of post 320. Lengthwise right angle support member 540 has a horizontal component 542 and a vertical component 544. Lengthwise right angle support member 540 is attached by bolting horizontal component 542 at its opposite ends to gusset plates 520 and 530 respectively. In the preferred embodiment, lengthwise right angle support member 500 is 8 feet long and the height of each component 502 and 504 is 6 inches. Similarly, in the preferred embodiment, lengthwise right angle support member 540 is 8 feet long and the height of each component 542 and 544 is 6 inches.

Figure 7:
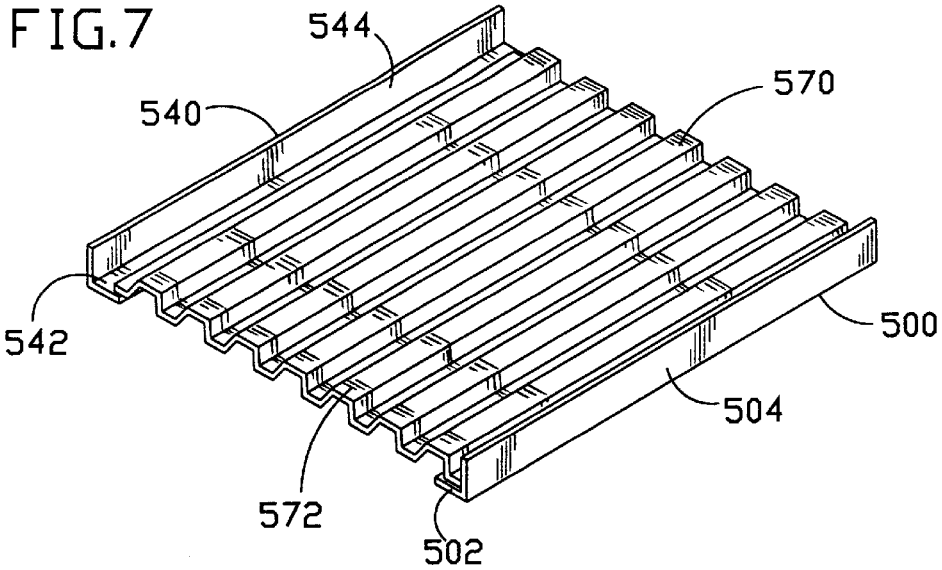
FIG. 7 is a perspective view of the metal bed forming the floor of the concrete bed and how it is supported by a pair of oppositely disposed lengthwise right angle support members.

After the above mentioned members are in place, a metal bed 570 is fastened to the horizontal components 502 and 542 of right angle support members 500 and 540. Referring to FIG. 7, in the preferred embodiment, metal bed 570 is 8 feet long and 36 inches wide. The floor 572 is positioned between right angle support members 500 and 540 such that it overlap each horizontal portion 502 and 542 by approximately 3 inches and the floor 572 is nailed to the horizontal portions 502 and 542. The height of the bed 570 is approximately 2 inches.

Figure 8:
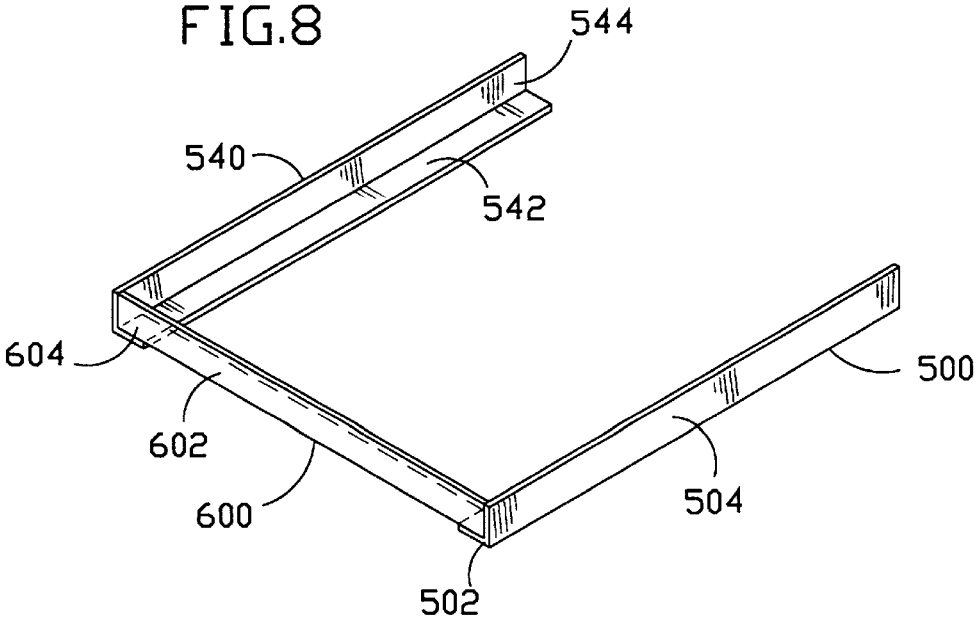
FIG. 8 is a perspective view of a transverse right angle support member which forms an end support for a concrete bed, and how it is supported by a pair of lengthwise right angle support members.

For each end of a given row a transverse right angle support member is positioned between two lengthwise right angle support members. The right angle support member is approximately 44 inches wide and has a horizontal portion and a vertical portion. The horizontal portion is 6 inches. The vertical portion is 5⅝ inches. In this way, the horizontal portion rests on top of the horizontal portions of the two lengthwise right angle support members and the overall height allowing for the ⅜ thickness of the support is 6 inches. Referring to FIG. 8, lengthwise right angle support members 500 and 540 are shown. Transverse right angle support member 600 has a horizontal portion 602 and a vertical portion 604. Transverse right angle support member 600 is positioned between the two lengthwise right angle support members 500 and 540 such that its horizontal portion 602 rests on horizontal portions 502 and 542 and is affixed thereto by means such as nailing. Due to the compensation for thickness of the horizontal portions 502 and 542 the total height of vertical portion 604 matches the height of vertical portions 504 and 544.

Figure 9:
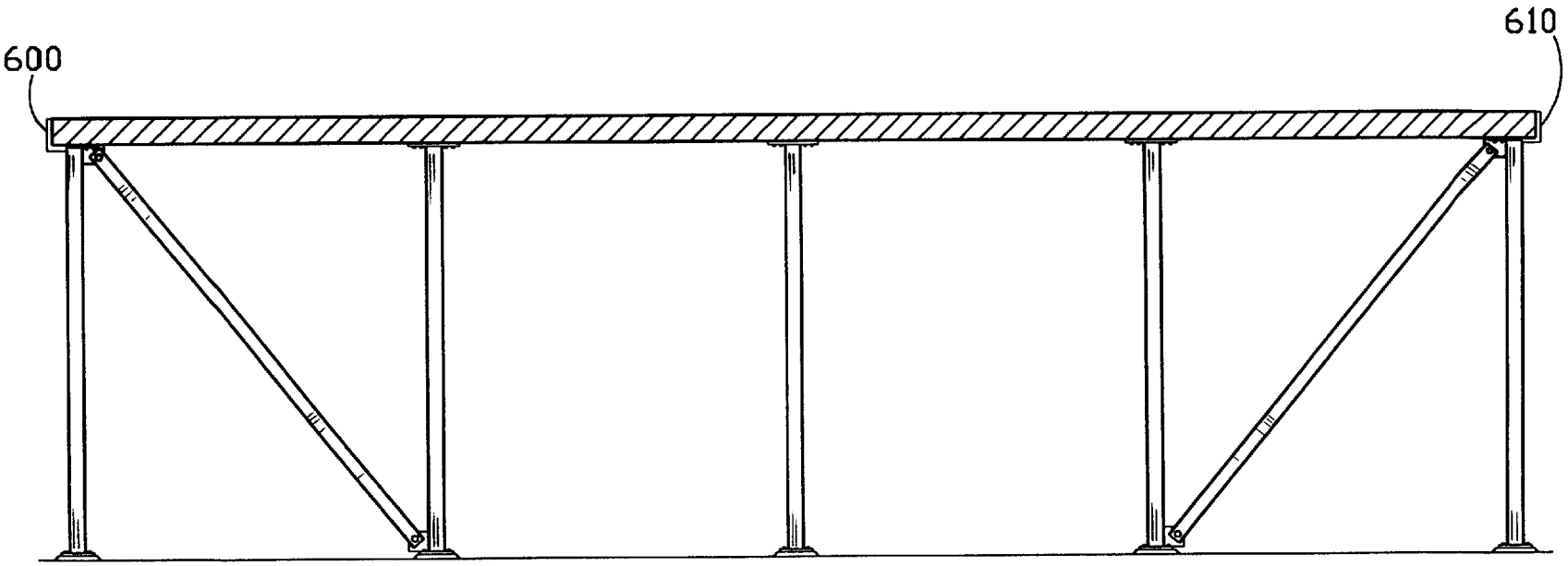
FIG. 9 is a lengthwise elevational view of the present invention illustrating the lengthwise extension of a concrete bed.

Therefore the system as disclosed and described in FIGS. 5, 6 and 7 is set up along the length of a given row and at the far ends of each row the transverse right angle support member 600 is affixed so that concrete can be poured into the multiplicity of beds which are surrounded by the lengthwise right angle support members along both lengthwise portions and retained at the ends of each row by the transverse right angle support members such as 600 and 610 as illustrated in FIG. 9. The result is a concrete bed which is 44 inches wide, 6 inches deep and the full length of the combined modular sections along a given row as illustrated in FIG. 9.

The three rows with finished concrete beds are illustrated in FIG. 3. The concrete bed 210 in row 200 is illustrative of the beds formed in accordance with the present invention. Referring to FIG. 3, concrete bed 200 lies flush against the lengthwise right angle support member and flush against the post, comparable to the way the concrete bed is depicted in FIG. 4. Therefore, the concrete bed is flush against the post in the rearward direction. At the front end, the concrete bed 220 ends in front of the post 210 comparable to the way the concrete bed is depicted in FIG. 4. In order to provide an aligned vertical surface, a plate 230 is positioned below the concrete bed 220 and extends downwardly to come in contact with the concrete bed 120 of immediately preceding row 100 as illustrated in FIG. 3. Each row is a given vertical height H1 above the preceding row, the height H1 being measured from the top of one concrete bed to the top of the concrete bed in the adjacent row. The preferred height H1 is 14 inches but the height H1 can be anywhere from 10 inches to 22 inches, depending on the number of rows in the theater and the overall height of the theater ceiling. Therefore, through the system of the present invention, a modular support structure can be quickly assembled and is designed to support a series of concrete beds which serve as the floors onto which the patron seats are affixed as illustrated in FIG. 1.

Figure 10:
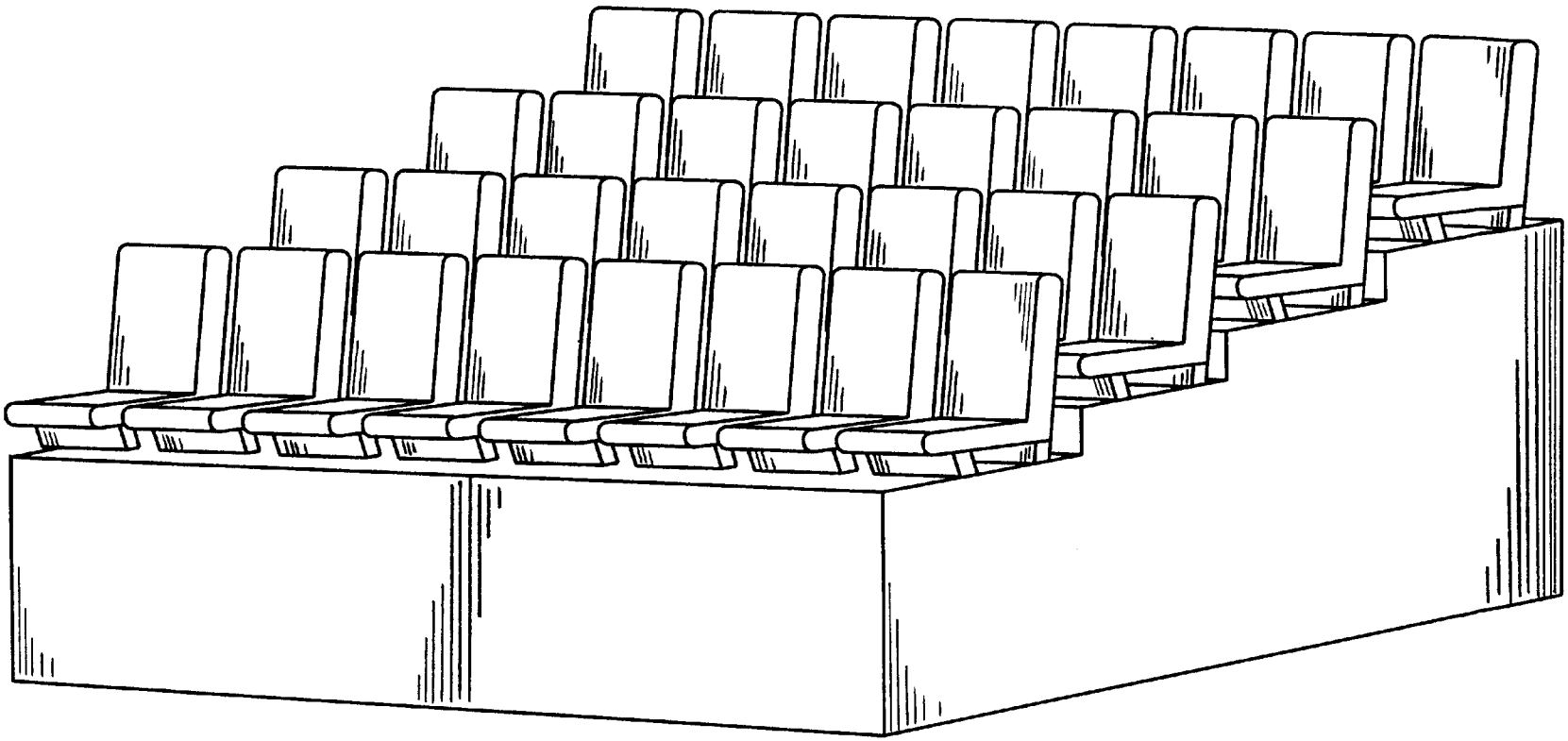
FIG. 10 is a perspective view of a portion of a completed present invention modular stadium seating support system support a multiplicity of seats is several rows.

A final finished assembly of the present invention is illustrated in FIG. 10. The present invention modular structure is assembled through a multiplicity of modules aligned in a series of horizontal rows, with each successive row being higher than the preceding row by a given height, for example 14 inches. Each row is composed of a series of adjacent modules of the same height in that row, the modules being composed of four vertical posts with adjacent modules sharing the same two intermediate posts between them. In alternating rows, the vertical posts are strengthened by widthwise crossbeams extending from adjacent the top of one vertical post to adjacent the bottom of the next vertical post for all widthwise pairs of vertical posts in the given row. In alternating rows, the vertical posts are further strengthened by lengthwise crossbeams extending from adjacent the top of one vertical post to adjacent the bottom of the next vertical post, with the lengthwise crossbeams being located on every other module in a given row or if there are only four modules in a given row, located on each module in each two sets of modules. The preferred dimension for each module is 8 feet long by 44 inches wide. Each vertical post is anchored to the ground by being welded to a horizontal plate which in turn in bolted or anchored into the ground. Each module supports a concrete formed bed in the manner previously described. The concrete bed is formed by a pair of oppositely disposed lengthwise right angle support members on each module which extend for the length of a given row and are bounded on each end of the row by a transverse right angle support member. A metal bed is supported by the oppositely disposed lengthwise right angle support members in each module to form the floor of the concrete bed and concrete is poured for the entire length and width of each module to form a floor in a given row. Seats are thereafter positioned on the concrete floor with approximately four to four and a half seats positioned on each 8 foot length of a module.

To assist in efficiency of erection, the various components can be color coded and/or individually piece marked to enable the construction personnel to quickly identify where a part belongs. For example, a post may be colored brown along its length adjacent to the ground and colored blue along its length adjacent to the ceiling. Similarly, gusset plates intended to be welded to posts adjacent their lower end could be colored brown and gusset plates intended to be welded to the posts adjacent their upper ends could be colored blue. With respect to widthwise crossbeams and lengthwise crossbeams, once again, portions intended to be bolted to gusset plates adjacent the ground could be colored brown and portions intended to be bolted to gusset plates adjacent the upper end of the posts could be colored blue. Clearly, brown is intended to mean the ground and blue is intended to mean the sky. However, any other consistent set of color coordinated parts would serve the same purpose.

Since the present invention is comprised of a series of simple consistent modular units, it is easy to assemble and unskilled or semi-skilled labor can be used, thereby reducing construction costs. In addition, since the parts are consistent and modular, the assembly can be rapid so that the downtime of an existing venue such as a movie theater is minimized.

Defined in detail, the present invention is a modular stadium seating support system, comprising: (a) a multiplicity of modules aligned in a series of horizontal rows having the same length, each row having a given width and height as defined by a module and a length formed from a series of adjacent modules aligned side to side, each horizontal row aligned behind its preceding row to form the multiplicity of rows having an overall width as defined by the combination of rows of modules and an overall length defined by the length of each row of modules, with each successive row being higher than the preceding row by a given height; (b) each module composed of four vertical posts, a module having a right front post and a left front post being the same height, and a right rear post and a left rear post being the same height and taller than the right front post and the left front post, with adjacent modules in the lengthwise directions sharing the same two intermediate posts between them, with the right rear post and left rear post in one row also acting as the right front post and left front post respectively in the next higher successive row, each vertical post affixed to a separate base plate assembly at one end of each post and means for anchoring each separate base plate assembly to a ground surface; (c) the vertical posts strengthened by widthwise crossbeams extending from adjacent the top of one vertical post to adjacent the bottom of an adjacent vertical post in the widthwise direction, a gusset plate being affixed to a vertical post at the location of connection and means for affixing an end of a widthwise crossbeam to its respective gusset plate, a widthwise crossbeam affixed in this manner to each front and rear post along the length of every other row of modules; (d) the vertical posts further strengthened by lengthwise crossbeams extending from adjacent the top of one vertical post to adjacent the bottom of an adjacent vertical post in the lengthwise direction, a gusset plate being affixed to a vertical post at the location of connection and means for affixing an end of a lengthwise crossbeam to its respective gusset plate, a lengthwise crossbeam affixed in this manner to one pair of rear vertical posts for each group of two modules along the length of every other row of modules, the widthwise crossbeams and the lengthwise crossbeam being located in the same rows of modules; (e) each module further including a gusset plate attached to adjacent the top of a front vertical post and an oppositely disposed gusset plate attached along the length of an oppositely disposed rear vertical post, a pair of right angle support members each having a vertical component attached to opposite sides of the two gusset plates and a horizontal component extending in opposite transverse directions to the two gusset plates; (f) each module along the length of each row further including a pair of oppositely disposed lengthwise right angle support members, the first lengthwise right angle support member having a vertical component and a horizontal component affixed to adjacent the top of the right front post and left front post, the second lengthwise right angle support member having a vertical component affixed to a position along the length of a right rear post and a left rear post at a location below the top of the posts and a horizontal component affixed to the horizontal components of the right angle support members, the horizontal components of both lengthwise right angle support members extending towards each other; (g) a first transverse right angle support member supported on a pair of oppositely disposed lengthwise right angle support members at one end of each row and a second oppositely disposed right angle support member supported on the pair of oppositely disposed lengthwise right angle support members at the opposite end in the row, each transverse right angle support member having a horizontal component affixed to the horizontal components of the lengthwise right angle support members and a vertical component adjoining a vertical component surface of a respective lengthwise right angle support member at opposite ends; (h) each module along the length of each row further including a bed positioned between the oppositely disposed lengthwise right angle support members, the bed having a floor which is affixed to the horizontal component of the oppositely disposed lengthwise right angle support members; and (i) a concrete surface poured into the portion of each row formed by the metal bed, the successive lengths of oppositely disposed lengthwise right angle support members in a row and the lengths of the oppositely disposed transverse right angle support members in the row; (j) whereby seats are affixed to the concrete surface to elevated above the seats in the immediately preceding row.

Defined broadly, the present invention is a modular stadium seating support system, comprising: (a) a multiplicity of modules aligned in a series of horizontal rows having the same length, each row having a horizontal rows having the same length, each row having a given width and height as defined by a module and a length formed from a series of adjacent modules aligned side to side, each horizontal row aligned behind its preceding row to form the multiplicity of rows having an overall width as defined by the combination of rows of modules and an overall length defined by the length of each row of modules, with each successive row being higher than the preceding row by a each successive row being higher than the preceding row by a given height; (b) each module composed of four vertical posts, a module having a right front post and a left front post being the same height, and a right rear post and a left rear post being left front post, with adjacent modules in the lengthwise direction sharing the same two intermediate posts between them, with the right rear post and left rear post in one row also acting as the right front post and left front post respectively in the next higher successive row, each vertical post affixed to a separate base plate assembly at one end of each post and means for anchoring each separate base plate assembly to a ground surface; (c) the vertical posts strengthened by widthwise crossbeams extending from adjacent the top of one vertical post to adjacent the bottom of an adjacent vertical post in the widthwise direction, and having means for affixing each end of a widthwise crossbeam to its respective vertical post, a widthwise crossbeam affixed in this manner to each front and rear post along the length of every other row of modules; (d) the vertical posts further strengthened by lengthwise crossbeams extending from adjacent the top of one vertical post to adjacent the bottom of an adjacent vertical post in the lengthwise direction, and having means for affixing each end of a lengthwise crossbeam to its respective vertical post, a lengthwise crossbeam affixed in this manner to one pair of rear vertical posts for each group of two modules along the length of every other row of modules, the widthwise crossbeams and the lengthwise crossbeam being located in the same rows of modules; (e) each module further including means for supporting a pair of right angle support members between oppositely disposed front and rear vertical posts, each right angle support member having a vertical component aligned parallel to be each and a horizontal component extending in opposite transverse directions; (f) each module along the length of each row further including a pair of oppositely disposed lengthwise right angle support members, the first lengthwise right angle support member having a vertical component and a horizontal component affixed to adjacent the top of the right front post and left front post, the second lengthwise right angle support member having a vertical component affixed to a position along the length of a right rear post and a left rear post at a location below the top of the posts and a horizontal component affixed to the horizontal components of the right angle support members, the horizontal components of both lengthwise right angle support members extending towards each other; (g) a first transverse right angle support member supported on a pair of oppositely disposed lengthwise right angle support members at one end of each row and a second oppositely disposed right angle support member supported on the pair of oppositely disposed lengthwise right angle support members at the opposite end in the row, each transverse right angle support member having a horizontal component affixed to the horizontal components of the lengthwise right angle support members and a vertical component adjoining a vertical component surface of a respective lengthwise right angle support member at opposite ends; (h) each module along the length of each row further including a bed positioned between the oppositely disposed lengthwise right angle support members, the bed having a floor which is affixed to the horizontal component of the oppositely disposed lengthwise right angle support members; and (i) a concrete surface poured into the portion of each row formed by the metal bed, the successive lengths of oppositely disposed lengthwise right angle support members in a row and the lengths of the oppositely disposed transverse right angle support members in the row; (j) whereby seats are affixed to the concrete surface to form a stadium seating venue where the seats in one row are elevated above the seats in the immediately preceding row.

Defined more broadly, the present invention is a modular stadium seating support system, comprising: (a) a multiplicity of modules aligned in a series of horizontal rows having the same length, each row having a given width and height as defined by a module and a length formed from a series of adjacent modules aligned side to side, each horizontal row aligned behind its preceding row to form the multiplicity of rows having an overall width as defined by the combination of rows of modules and an overall length defined by the length of each row of modules, with each successive row being higher than the preceding row by a given height; (b) each module composed of four vertical posts, a module having a right front post and a left front post being the same height, and a right rear post and a left rear post being the same height and taller than the right front post and the left front post, with adjacent modules in the lengthwise direction sharing the same two intermediate posts between them, with the right rear post and left rear post in one row also acting as the right front post and left front post respectively in the next higher successive row, each vertical post affixed to a separate base plate assembly at one end of each post and means for anchoring each separate base plate assembly to a ground surface; (c) the vertical posts strengthened by widthwise crossbeams extending from adjacent the top of one vertical post to adjacent the bottom of an adjacent vertical post in the widthwise direction, and having means for affixing each end of a widthwise crossbeam to its respective vertical post, a widthwise crossbeam affixed in this manner to selected vertical posts; (d) the vertical posts further strengthened by lengthwise crossbeams extending from adjacent the top of one vertical post to adjacent the bottom of an adjacent vertical post in the lengthwise direction, and having means for affixing each end of a lengthwise crossbeam to its respective vertical post, a lengthwise crossbeam affixed in this manner to selected vertical posts; (e) each module along the length of each row further including a pair of oppositely disposed lengthwise right angle support members, the first lengthwise right angle support member having a vertical component and a horizontal component and being affixed to adjacent the top of the right front post and left front post, the second lengthwise right angle support member having a vertical component and a horizontal component, and affixed to a position along the length of a right rear post and a left rear post at a location below the top of the posts the horizontal components of both lengthwise right angle support members extending towards each other; (f) a first transverse right angle support member supported on a pair of oppositely disposed lengthwise right angle support members at one end of each row and a second oppositely disposed right angle support member supported on the pair of oppositely disposed lengthwise right angle support members at the opposite end in the row, each transverse right angle support member having a horizontal component and a vertical component adjoining a vertical component surface of a respective lengthwise right angle support member at opposite ends; (g) each module along the length of each row further including a bed positioned between the oppositely disposed lengthwise right angle support members, the bed having a floor which is affixed to the horizontal component of the oppositely disposed lengthwise right angle support members; and (h) a concrete surface poured into the portion of each row formed by the metal bed, the successive lengths of oppositely disposed lengthwise right angle support members in a row and the lengths of the oppositely disposed transverse right angle support members in the row; (i) whereby seats are affixed to the concrete surface to form a stadium seating venue where the seats in one row are elevated above the seats in the immediately preceding row.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A modular stadium seating support system, comprising:

a. a multiplicity of modules aligned in a series of horizontal rows having the same length, each row having a given width and height as defined by a module and a length formed from a series of adjacent modules aligned side to side, each horizontal row aligned behind its preceding row to form the multiplicity of rows having an overall width as defined by the combination of rows of modules and an overall length defined by the length of each row of modules, with each successive row being higher than the preceding row by a given height;

b. each module composed of four vertical posts, a module having a right front post and a left front post being the same height, and a right rear post and a left rear post being the same height and taller than the right front post and the left front post, with adjacent modules in the lengthwise directions sharing the same two intermediate posts between them, with the right rear post and left rear post in one row also acting as the right front post and left front post respectively in the next higher successive row, each vertical post affixed to a separate base plate assembly at one end of each post and means for anchoring each separate base plate assembly to a ground surface;

c. the vertical posts strengthened by widthwise crossbeams extending from adjacent the top of one vertical post to adjacent the bottom of an adjacent vertical post in the widthwise direction, a gusset plate being affixed to a vertical post at the location of connection and means for affixing an end of a widthwise crossbeam to its respective gusset plate, a widthwise crossbeam affixed in this manner to each front and rear post along the length of every other row of modules;

d. the vertical posts further strengthened by lengthwise crossbeams extending from adjacent the top of one vertical post to adjacent the bottom of an adjacent vertical post in the lengthwise direction, a gusset plate being affixed to a vertical post at the location of connection and means for affixing an end of a lengthwise crossbeam to its respective gusset plate, a lengthwise crossbeam affixed in this manner to one pair of rear vertical posts for each group of two modules along the length of every other row of modules, the widthwise crossbeams and the lengthwise crossbeam being located in the same rows of modules;

e. each module further including a gusset plate attached to adjacent the top of a front vertical post and an oppositely disposed gusset plate attached along the length of an oppositely disposed rear vertical post, a pair of right angle support members each having a vertical component attached to opposite sides of the two gusset plates and a horizontal component extending in opposite transverse directions to the two gusset plates;

f. each module along the length of each row further including a pair of oppositely disposed lengthwise right angle support members, the first lengthwise right angle support member having a vertical component and a horizontal component affixed to adjacent the top of the right front post and left front post, the second lengthwise right angle support member having a vertical component affixed to a position along the length of a right rear post and a left rear post at a location below the top of the posts and a horizontal component affixed to the horizontal components of the right angle support members, the horizontal components of both lengthwise right angle support members extending towards each other;

g. a first transverse right angle support member supported on a pair of oppositely disposed lengthwise right angle support members at one end of each row and a second oppositely disposed right angle support member supported on the pair of oppositely disposed lengthwise right angle support members at the opposite end in the row, each transverse right angle support member having a horizontal component affixed to the horizontal components of the lengthwise right angle support members and a vertical component adjoining a vertical component surface of a respective lengthwise right angle support member at opposite ends;

h. each module along the length of each row further including a bed positioned between the oppositely disposed lengthwise right angle support members, the bed having a floor which is affixed to the horizontal component of the oppositely disposed lengthwise right angle support members; and i. a concrete surface poured into the portion of each row formed by the metal bed, the successive lengths of oppositely disposed lengthwise right angle support members in a row and the lengths of the oppositely disposed transverse right angle support members in the row;

j. whereby seats are affixed to the concrete surface be to elevated above the seats in the immediately preceding row.

2. A modular stadium seating support system, comprising:

a. a multiplicity of modules aligned in a series of horizontal rows having the same length, each row having a horizontal rows having the same length, each row having a given width and height as defined by a module and a length formed from a series of adjacent modules aligned side to side, each horizontal row aligned behind its preceding row to form the multiplicity of rows having an overall width as defined by the combination of rows of modules and an overall length defined by the length of each row of modules, with each successive row being higher than the preceding row by by a given height;

b. each module composed of four vertical posts, a module having a right front post and a left front post being the same height, and a right rear post and a left rear post being left front post, with adjacent modules in the lengthwise direction sharing the same two intermediate posts between them, with the right rear post and left rear post in one row also acting as the right front post and left front post respectively in the next higher successive row, each vertical post affixed to a separate base plate assembly at one end of each post and means for anchoring each separate base plate assembly to a ground surface;

c. the vertical posts strengthened by widthwise crossbeams extending from adjacent the top of one vertical post to adjacent the bottom of an adjacent vertical post in the widthwise direction, and having means for affixing each end of a widthwise crossbeam to its respective vertical post, a widthwise crossbeam affixed in this manner to each front and rear post along the length of every other row of modules;

d. the vertical posts further strengthened by lengthwise crossbeams extending from adjacent the top of one vertical post to adjacent the bottom of an adjacent vertical post in the lengthwise direction, and having means for affixing each end of a lengthwise crossbeam to its respective vertical post, a lengthwise crossbeam affixed in this manner to one pair of rear vertical posts for each group of two modules along the length of every other row of modules, the widthwise crossbeams and the lengthwise crossbeam being located in the same rows of modules;

e. each module further including means for supporting a pair of right angle support members between oppositely disposed front and rear vertical posts, each right angle support member having a vertical component aligned parallel to each other and each right angle support member having a horizontal component extending in opposite transverse directions to the vertical component;

f. each module along the length of each row further including a pair of oppositely disposed lengthwise right angle support members, the first lengthwise right angle support member having a vertical component and a horizontal component affixed to adjacent the top of the right front post and left front post, the second lengthwise right angle support member having a vertical component affixed to a position along the length of a right rear post and a left rear post at a location below the top of the posts and a horizontal component affixed to the horizontal components of the right angle support members, the horizontal components of both lengthwise right angle support members extending towards each other;

g. a first transverse right angle support member supported on a pair of oppositely disposed lengthwise right angle support members at one end of each row and a second oppositely disposed right angle support member supported on the pair of oppositely disposed lengthwise right angle support members at the opposite end in the row, each transverse right angle support member having a horizontal component affixed to the horizontal components of the lengthwise right angle support members and a vertical component adjoining a vertical component surface of a respective lengthwise right angle support member at opposite ends;

h. each module along the length of each row further including a bed positioned between the oppositely disposed lengthwise right angle support members, the bed having a floor which is affixed to the horizontal component of the oppositely disposed lengthwise right angle support members; and i. a concrete surface poured into the portion of each row formed by the metal bed, the successive lengths of oppositely disposed lengthwise right angle support members in a row and the lengths of the oppositely disposed transverse right angle support members in the row;

j. whereby seats are affixed to the concrete surface to form a stadium seating venue where the seats in one row are elevated above the seats in the immediately preceding row.

3. A modular stadium seating support system, comprising:

a. a multiplicity of modules aligned in a series of horizontal rows having the same length, each row having a given width and height as defined by a module and a length formed from a series of adjacent modules aligned side to side, each horizontal row aligned behind its preceding row to form the multiplicity of rows having an overall width as defined by the combination of rows of modules and an overall length defined by the length of each row of modules, with each successive row being higher than the preceding row by a given height;

b. each module composed of four vertical posts, a module having a right front post and a left front post being the same height, and a right rear post and a left rear post being the same height and taller than the night front post and the left front post, with adjacent modules in the lengthwise direction sharing the same two intermediate posts between them, with the right rear post and left rear post in one row also acting as the right front post and left front post respectively in the next higher successive row, each vertical post affixed to a separate base plate assembly at one end of each post and means for anchoring each separate base plate assembly to a ground surface;

c. the vertical posts strengthened by widthwise crossbeams extending from adjacent the top of one vertical post to adjacent the bottom of an adjacent vertical post in the widthwise direction, and having means for affixing each end of a widthwise crossbeam to its respective vertical post, a widthwise crossbeam affixed in this manner to selected vertical posts;

d. the vertical posts further strengthened by lengthwise crossbeams extending from adjacent the top of one vertical post to adjacent the bottom of an adjacent vertical post in the lengthwise direction, and having means for affixing each end of a lengthwise crossbeam to its respective vertical post, a lengthwise crossbeam affixed in this manner to selected vertical posts;

e. each module along the length of each row further including a pair of oppositely disposed lengthwise right angle support members, the first lengthwise right angle support member having a vertical component and a horizontal component and being affixed to adjacent the top of the right front post and left front post, the second lengthwise right angle support member having a vertical component and a horizontal component, and affixed to a position along the length of a right rear post and a left rear post at a location below the top of the posts the horizontal components of both lengthwise right angle support members extending towards each other;

f. a first transverse right angle support member supported on a pair of oppositely disposed lengthwise right angle support members at one end of each row and a second oppositely disposed right angle support member supported on the pair of oppositely disposed lengthwise right angle support members at the opposite end in the row, each transverse right angle support member having a horizontal component and a vertical component adjoining a vertical component surface of a respective lengthwise right angle support member at opposite ends;

g. each module along the length of each row further including a bed positioned between the oppositely disposed lengthwise right angle support members, the bed having a floor which is affixed to the horizontal component of the oppositely disposed lengthwise right angle support members; and h. a concrete surface poured into the portion of each row formed by the metal bed, the successive lengths of oppositely disposed lengthwise right angle support members in a row and the lengths of the oppositely disposed transverse right angle support members in the row;

i. whereby seats are affixed to the concrete surface to form a stadium seating venue where the seats in one row are elevated above the seats in the immediately preceding row.

4. The invention as defined in claims 1, 2 or 3 wherein the horizontal lengthwise distance between adjacent left and right vertical posts in each module is 8 feet.

5. The invention as defined in claims 1, 2, or 3 wherein the widthwise distance between adjacent front and rear vertical posts in each module is 44 inches.

6. The invention as defined in claims 1, 2 or 3 wherein the difference in height from one row to an adjacent row is between 10 inches and 22 inches.

7. The invention as defined in claims 1, 2 or 3 wherein each vertical post is made of steel, each lengthwise support beam is made of steel, each transverse support beam is made of steel, and each crossbeam is made of steel.

8. The invention as defined in claims 1, 2 or 3 wherein the rearmost row of modules has all four vertical posts the same height and all lengthwise support beams and all transverse support beams are attached adjacent the top of each vertical post in the row.

9. The invention as defined in claims 1, 2 or 3 wherein all structural components are color coded for ease of assembly.

10. The invention as defined in claims 1, 2 or 3 wherein all structural components are individually piece marked for ease of assembly.

11. The invention as defined in claims 1, 2 or 3 wherein said base plate assembly comprises a base plate welded to the bottom of said vertical post and said means for anchoring each separate base plate assembly further comprises a pair of spaced apart openings in the base plate and an anchor extending through each opening and extending into the ground surface on which the base plate rests.

12. The invention as defined in claims 1, 2 or 3 wherein said base plate assembly comprises a base plate having a pair of aligned spaced apart plates affixed perpendicularly to the base plate and pivot means pivotally mounting said vertical post to said pair spaced apart plates so that said vertical post can rotate relative to said base plate, and said means for anchoring each separate base plate assembly further comprises a pair of spaced apart openings in the base plate and an anchor extending through each opening and extending into the ground surface on which the base plate rests.

* * * * *